US009569945B2

(12) United States Patent
Zumsteg et al.

(10) Patent No.: US 9,569,945 B2
(45) Date of Patent: Feb. 14, 2017

(54) SYSTEM AND METHOD FOR FIRE PROGRESS MONITORING

(71) Applicant: Honeywell International Inc., Morristown, NJ (US)

(72) Inventors: Philip Zumsteg, Shorewood, MN (US); Andrew G. Berezowski, Wallingford, CT (US)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 73 days.

(21) Appl. No.: 14/568,254

(22) Filed: Dec. 12, 2014

(65) Prior Publication Data

US 2016/0171857 A1 Jun. 16, 2016

(51) Int. Cl.
*G08B 17/10* (2006.01)
*G08B 29/04* (2006.01)

(52) U.S. Cl.
CPC ..... *G08B 17/10* (2013.01); *G08B 29/04* (2013.01)

(58) Field of Classification Search
CPC ..... G08B 17/00; G08B 19/00
USPC ..... 340/628
See application file for complete search history.

(56) References Cited

U.S. PATENT DOCUMENTS

| | | | | |
|---|---|---|---|---|
| 5,309,146 | A * | 5/1994 | Kenet | G08B 19/005 340/540 |
| 7,639,147 | B2 | 12/2009 | Berezowski et al. | |
| 7,797,116 | B2 | 9/2010 | Berezowski et al. | |
| 8,466,785 | B2 * | 6/2013 | Kamalakannan | G08B 17/10 340/524 |
| 2004/0051739 | A1 * | 3/2004 | Schmickley | G08B 17/10 715/772 |
| 2009/0045937 | A1 * | 2/2009 | Zimmerman | G08B 17/10 340/506 |
| 2013/0024800 | A1 * | 1/2013 | Sundriyal | G08B 25/14 715/772 |

* cited by examiner

*Primary Examiner* — Toan N Pham
(74) *Attorney, Agent, or Firm* — Husch Blackwell LLP

(57) ABSTRACT

A system is provided that includes a plurality of fire detectors distributed throughout a secured geographic area, a monitoring panel that detects a status of each of the plurality of fire detectors and saves a status indicator of the fire detector indicating one of normal, alarm, and fault into a memory along with a time value, an alarm processor of the monitoring panel that detects alarm signals from the plurality of fire detectors and presents respective indicators of the activated fire detectors on a geographic map of the secured area shown on a display, and a fire progression processor that displays an indicator of a progression of a fire on the map of the display based upon the status indicators saved in memory and upon a correlation between a status indicator of alarm in a previous time period and a status indicator of fault in a more recent time period.

20 Claims, 4 Drawing Sheets

| Sensor | Reading |
|---|---|
| Ionization | Normal |
| Photoelectric | Alarm |
| IR | Alarm |
| Laser | Alarm |
| Heat | Normal |
| CO | Normal |

Fire Signature - Smoldering

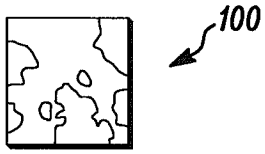

FIG. 2A

| Sensor | Reading |
|---|---|
| Ionization | Alarm |
| Photoelectric | Normal |
| IR | Normal |
| Laser | Normal |
| Heat | Alarm |
| CO | Normal |

Fire Signature - Flames

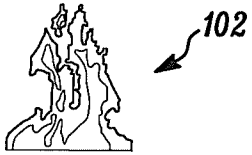

FIG. 2B

| Sensor | Reading |
|---|---|
| Ionization | Alarm |
| Photoelectric | Normal |
| IR | Alarm |
| Laser | Normal |
| Heat | Alarm |
| CO | Alarm |

Fire Signature - Chemical

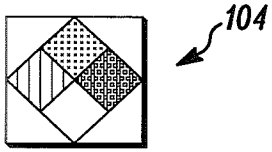

FIG. 2C

Fire Profile in 3-D

SYSTEM AND METHOD FOR FIRE PROGRESS MONITORING

FIELD

This application relates to security systems and, more particularly, to fire detection systems.

BACKGROUND

Systems are known to protect people and assets within secured areas. Such systems are typically based upon the use of one more sensors that detect threats within the secured area.

Threats to people and assets may originate from any of a number of different sources. For example, a fire may kill or injure occupants who become trapped by a fire in a home. Similarly, carbon monoxide from a fire may kill people in their sleep.

In most cases, threat detectors are connected to a local control panel. In the event of a threat detected via one of the sensors, the control panel may sound a local audible alarm. The control panel may also send a signal to a central monitoring station.

Located on the control panel or nearby may be a display screen that displays the status of the fire and/or security system. In some cases, the display may include a map that shows fire detectors and a status of each detector.

The display may also show a separate window that includes a list of identifiers of activated fire detector and a time of activation. The map of fire detectors and the time of activation may be very important for firefighting personnel arriving to fight the fire. The maps provide an indication of activated fire alarms, and the list provides a time of activation. By viewing the map, the fire-fighter is able to determine a location of the fire and a path to the fire.

While fire and/or security systems work well, the displays are sometimes difficult to interpret. This is especially the case in the situation where a fire-fighter is unfamiliar with the secured area and/or where the fire has enveloped large areas of a facility. Accordingly, a need exists for better methods of displaying fire information.

BRIEF DESCRIPTION OF THE DRAWINGS

FIGS. 2A, 2B, and 2C depict fire signatures that may be used by the system of FIG. 1;

DETAILED DESCRIPTION

Figure 1:
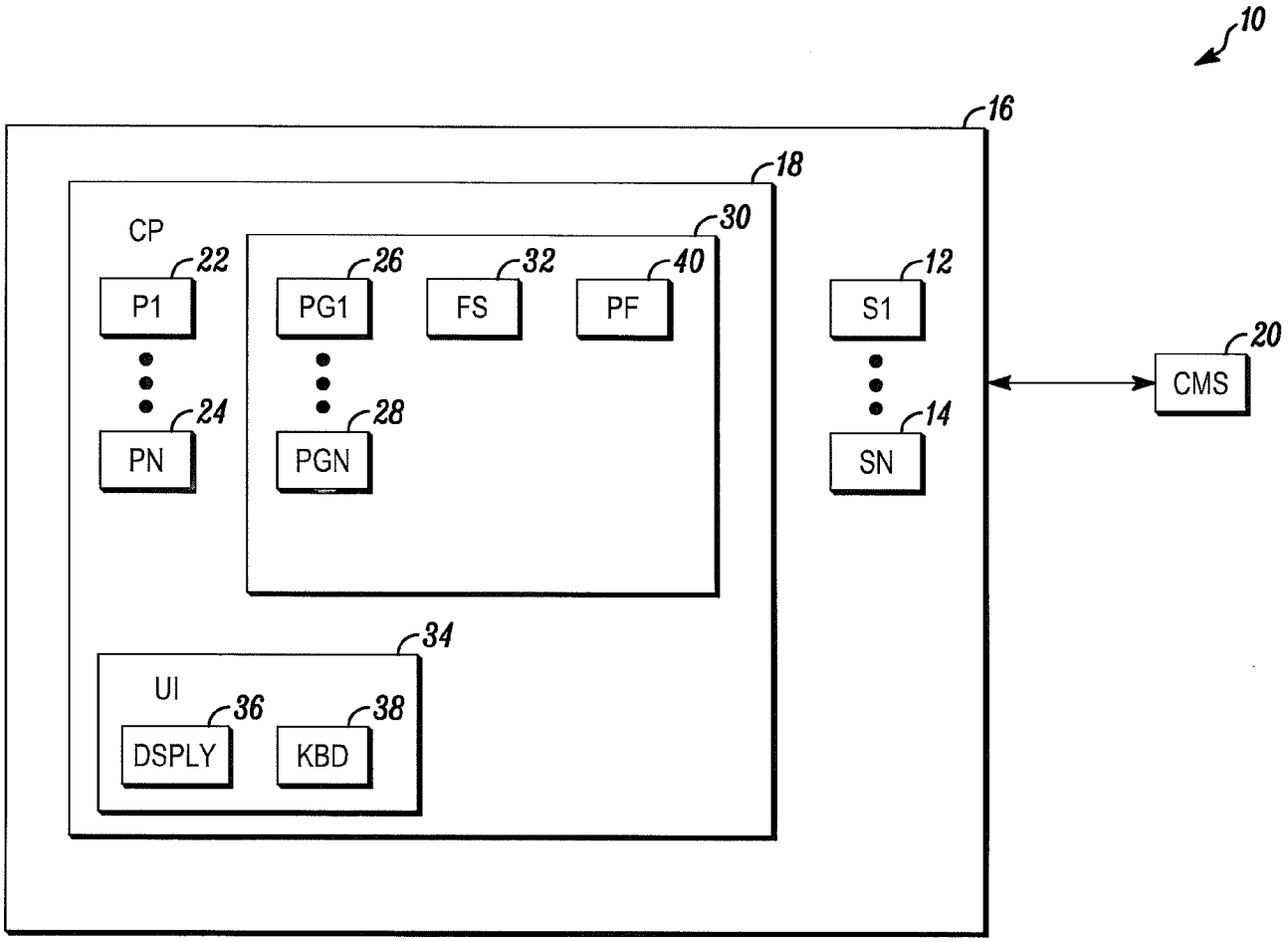
FIG. 1 illustrates a block diagram of a surveillance system in accordance herewith.

While disclosed embodiments can take many different forms, specific embodiments thereof are shown in the drawings and will be described herein in detail with the understanding that the present disclosure is to be considered as an exemplification of the principles thereof as well as the best mode of practicing the same and is not intended to limit the application or claims to the specific embodiment illustrated.

FIG. 1 is a block diagram of a fire detection system 10 shown generally in accordance with an illustrated embodiment. Included within the system is a number of fire detector devices 12, 14 that detect fires within a protected geographic area 16.

The fire detection devices may include single detector devices or multi-function devices. Multi-function devices may refer to a single device with more than one fire detector, or it may refer to a single communication cable with more than one detector connected to the cable. Where the fire detectors are multi-function devices, the multi-function device may include a combination of two or more of an ionization detector, a photoelectric detector, an infrared detector, a laser detector, a heat detector, and a carbon monoxide detector.

The fire detection devices may also include multi-function acoustic sensors (MFASs). The fire detection devices may also include water sprinkler flow detection as described in U.S. Pat. No. 7,797,116 or PASS devices described in U.S. Pat. No. 7,639,147.

A control panel 18 may monitor each of the fire detectors for activation. Upon activation, the control panel may compose and send an alarm message to a central monitoring station 20.

The fire detectors may be wired or wirelessly connected to the control panel through a corresponding wired or wireless network. The fire detectors all have a separate unique system address and are all separately addressable by the control panel. In the case of a multi-function detector, a multiplexer within the multi-function detector allows each of the fire detectors of the multi-function detector to be separately accessed by the control panel.

Included within the control panel and each of the fire detectors are one or more processor apparatuses (processors) 22, 24 each operating under control of one or more computer programs 26, 28 loaded from a non-transitory computer readable medium (memory) 30. As used herein, reference to a step performed by a computer program is also reference to the processor that executed that step.

Within the control panel, a monitoring processor monitors the status of each of the fire detectors. Monitoring, in this case, means detecting a normal state, an alarm state, a trouble state, and a failure of the branch circuit that includes the fire detector. In this regard, a trouble state may mean an abnormal state detected within the fire detector by circuitry that monitors the operating parameters of a sensor of the fire detector. In contrast, failure of a branch circuit may mean a short or open circuit of a cable in the case of a wired branch circuit or failure of a radio frequency (RF) transceiver in the case of a wireless branch circuit.

Under the illustrated embodiment, the three state conditions of a conventional fire sensor (i.e., normal, alarm, trouble) are extended to a four state mode of operation. In this regard, the fourth state considers the possibility of failure of a corresponding branch circuit.

For example, in the case of a fire, very high heat can cause physical failure of a fire detector. In the case of a multi-function sensor, one or more of the detectors could fail while leaving the others intact. However, the very high heat could also cause failure of a communications branch circuit.

In general, alarm failure may be caused by any of a number of different conditions. In the case of a multi-function detector, the failure of any one detector to enter an alarm state may indicate that communications are intact with loss of communications due to a particular failure mode of only a single detector. In this case, the fire alarm control panel (FACP) confirms communication loss by checking the cable for open or short-circuit conditions or verifying wireless device operation(s). When one or more devices on a cable are detected as intact (not failed), then the remaining devices that are in alarm may be used to determine a fire path.

In one particular example, the FACP may detect failure of a branch circuit including at least some fire detectors that were not in an alarm state and some devices that were in an alarm state. Under the illustrated embodiment, only the devices that were in an alarm state before branch circuit failure are used to detect the path of a fire.

Alternatively, some buildings may have a dual cable arrangement with one of the two cables routed along the length of the building on each side and fire detectors along the length alternatively connected to the fire and second cables. In this case, the location of the cables and activated sensors before failure of one of the two cables may be used as additional information in determining fire spread.

As mentioned above, a conventional fire panel considers three states, including a normal state where no fire is detected, an alarm state where a fire is detected, and a trouble state. Conventional FACP annunciators typically latch the alarm or normal indicator in the event of a trouble signal, thereby hiding any trouble or failure states.

In contrast, the system of FIG. 1 incorporates the information of four states, including a normal state where no fire is detected, an alarm state where a fire is detected, a trouble state after a normal state where no fire is detected, and a failure state after an alarm, which may indicate a severe fire. Key to the determination of state is establishing whether the failure is due to loss of functionality of the sensor or communication to the sensor. In the case of loss of communication to a sensor, the failure state is determined by the FACP when the detector does not respond to a polling command (i.e., no communication with the fire detector is possible). Also important is the time determination of the alarm. In this case the time determination contains useful fire progress information.

As mentioned above, the fire detectors used in the system of FIG. 1 may utilize multiple sensor types, including ionization, photoelectric, IR, laser, heat, CO, etc. The different types may be co-located in the same monitored area or within the same detectors. In this case, the time sequence of sensor readings may be used to indicate the approximate fire temperature and/or may also indicate fuel source(s).

In the case of multiple sensors, the readings of the different sensors may be used to indicate a fire signature. In this case, each of the fire detectors in a particular region may be simultaneously read and considered in combination to arrive at a fire signature. The fire signature may be used to determine the state of a fire in that region.

For example, FIG. 2A illustrates an example of a fire signature including a combination of activated sensors for a smoldering fire, FIG. 2B illustrates an example of a fire signature for a fire having open flames, and FIG. 2C illustrates a fire signature for a chemical fire. As shown in FIG. 2A, a signature for a smoldering fire may include the combination of an ionization detector in a normal state, a photoelectric detector in an alarm state, an IR detector in an alarm state, a laser detector in an alarm state, a heat detector in a normal state, and a CO detector in a normal state. Similarly, a signature for open flames may include the combination of an ionization detector in an alarm state, a photoelectric detector in normal state, an IR detector in a normal state, a laser detector in normal state, a heat detector in an alarm state and a CO detector in a normal state. A signature for a chemical fire may include the combination of an ionization detector in an alarm state, a photoelectric detector in a normal state, an IR detector in an alarm state, a laser detector in a normal state, a heat detector in an alarm state, and a CO detector in an alarm state.

In general, a set of signatures, such as those shown in FIGS. 2A-2C, are saved as a set of fire signatures in memory as one or more files 32. Upon the detection of a fire, a fire state processor may retrieve a set of readings from each of the sensors in an area, combine those readings to create an instantaneous signature of a current fire status, and compare that signature with the fire signatures within memory. From that comparison, the status processor is able to characterize the fire over a time period for each zone of the secured area and save those characterizations in a fire progression file 40 for later presentation on a display 36 of a user interface 34.

Figure 3:
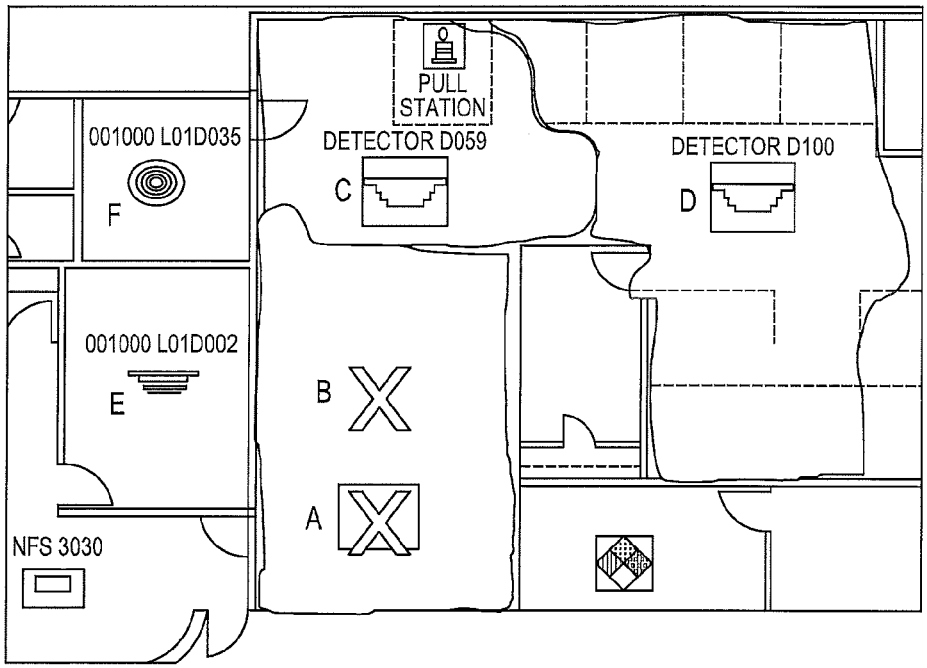
FIG. 3 depicts a map of fire conditions that may be displayed by the system of FIG. 1.

FIG. 3 depicts an example of a heat map that is presented on the display of the user interface. FIG. 3 shows a map of the secured area in which heat information (from the saved information) has been superimposed over the map. In this case, the temperature has been used to shade the zones of the map so that the zones with the highest temperature have the greatest shading. In FIG. 3, zones A and B are shown as having the highest measured temperatures. FIG. 3 also shows that after measuring the highest temperatures, the temperature sensors of zones A and B have failed. Failure of the sensors is shown by superimposing an "X" over the sensors in that zone. Similarly, zone C is shown as having a relatively high temperature via a different level of shading. Zone D is shown as depicting smoke via a still different level of shading. Zones E and F are shown as having no alarms and having a status of normal.

It should also be noted that a unique icon that depicts each fire condition could also be depicted on the display in addition to or in the alternative to shading. For example, FIG. 2A shows an icon 100 that could be superimposed over the appropriate zone of FIG. 3 for identifying a zone with a smoldering fire, FIG. 2B shows an icon 102 that can be used for open flames, and FIG. 2C shows an icon 104 that can be used for identifying a chemical fire.

Figure 4:
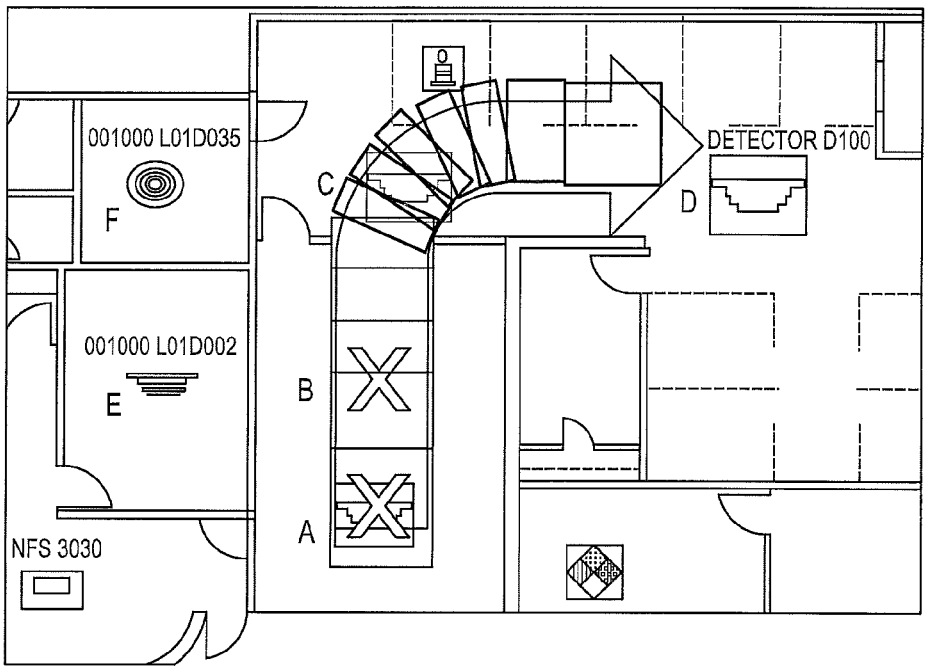
FIG. 4 depicts a map of fire progression that may be displayed by the system of FIG. 1.

Alternatively, the information from the fire progression file may also be used to depict a fire vector as shown in FIG. 4. In this situation, at time t=0 seconds, an alarm is detected in zone A. At t=30 seconds, the fire detector in zone B goes into alarm. At time t=90 seconds, the fire detector in zone A fails. At time t=110, an alarm in zone C is detected. At time t=180 seconds, the detector in zone B fails. At time t=360 seconds, an alarm in zone D is detected. In FIG. 4, the most recent event (i.e., t=360 seconds) is shown with an arrow pointed in the direction of the progression of the fire.

In general, the segments shown in FIG. 3 depict a 30 second interval. The length of the segments indicates the rate of fire growth. The thinner segments (around the corner) indicate faster fire growth.

Figure 5:
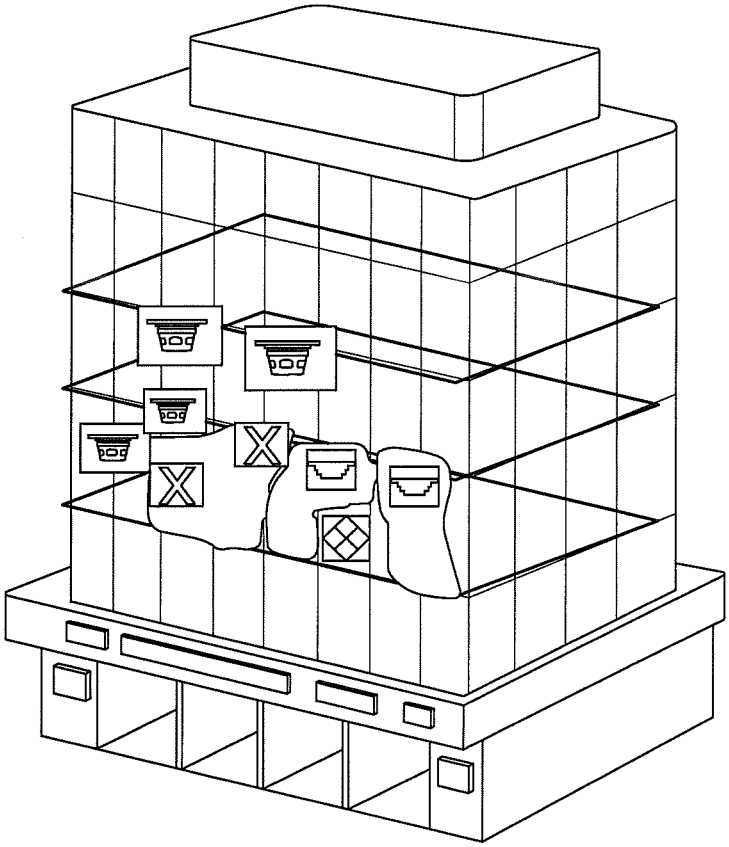
FIG. 5 depicts a map of fire conditions in a 3-D map that may be displayed by the system of FIG. 1.

Alternatively, the information from the fire progression file may also be used to depict a three dimensional visualization of a fire as shown in FIG. 5. In this case, the vertical shading indicates the vertical dimensions of the fire. The icons indicating the type of fire (e.g., chemical) can be superimposed over the shading. In this figure, the state/time can be shown in sequence. In this example, detectors in a normal state are shown with the corresponding zone with grey shading, detectors in alarm are shown with red shading, and failed detectors are shown with a superimposed "X".

The map of FIG. 5 can also show the fire profile. For example, very hot zones can be shown in bright red, hot fires can be shown in red, and smoke can be shown as grey.

In general, FIG. 5 shows the mapping between detectors and the physical structure. The failure of detectors and/or communication cables are shown with a superimposed red "X".

In general, the system includes a plurality of fire detectors distributed throughout a secured geographic area, a monitoring panel that monitors each of the plurality of fire detectors, a status processor that periodically detects a status of each of the plurality of fire detectors and saves a status indicator of the fire detector indicating one of normal, alarm, and fault into a memory along with a time value, an alarm processor of the monitoring panel that detects alarm signals from the plurality of fire detectors and presents respective indicators of the activated fire detectors on a geographic map of the secured area shown on a display, and a fire progression processor that displays an indicator of a progression of a fire on the map of the display based upon the status indicators saved in memory and upon a correlation between a status indicator of alarm in a previous time period and a status indicator of fault in a more recent time period.

Alternatively, the system includes a plurality of fire detectors distributed throughout a secured geographic area, a monitoring processor that monitors each of the plurality of fire detectors for alarm messages from activated fire detectors and for trouble messages from malfunctioning fire detectors, a correlation processor that detects a trouble message immediately following an alarm message from one of the plurality of fire detectors, and a fire progression processor that displays an indicator of progression of a fire on a map of the secured area presented on a display based upon the detected trouble message immediately following the alarm message from the one fire detector.

Alternatively, the system includes a fire detection system that protects a secured geographic area divided into a plurality of zones, a plurality of fire detectors distributed throughout the secured geographic area with at least one of the plurality of fire detectors disposed in each of the plurality of zones, a monitoring processor that monitors each of the plurality of fire detectors for alarm messages from activated fire detectors and for trouble messages from malfunctioning fire detectors, a correlation processor that detects a trouble message immediately following an alarm message from one of the plurality of fire detectors, and a fire progression processor that displays an indicator of progression of a fire in at least some adjacent zones of the plurality of zones shown on a map of the secured area presented on a display based upon the detected trouble message immediately following the alarm message from the one fire detector.

From the foregoing, it will be observed that numerous variations and modifications may be effected without departing from the spirit and scope hereof. It is to be understood that no limitation with respect to the specific apparatus illustrated herein is intended or should be inferred. It is, of course, intended to cover by the appended claims all such modifications as fall within the scope of the claims. Further, logic flows depicted in the figures do not require the particular order shown or sequential order to achieve desirable results. Other steps may be provided, steps may be eliminated from the described flows, and other components may be added to or removed from the described embodiments.

The invention claimed is:

1. An apparatus comprising:

a plurality of fire detectors distributed throughout a secured geographic area;

a monitoring panel that monitors each of the plurality of fire detectors;

a status processor that periodically detects a status of each of the plurality of fire detectors and saves a status indicator for each of the plurality of fire detectors along with a time value, into a memory, wherein the status indicator for each of the plurality of fire detectors indicates a normal status, an alarm status, or a fault status for a respective one of the plurality of fire detectors, and wherein the fault status indicates failure of one of the plurality of fire detectors;

an alarm processor of the monitoring panel that detects an alarm signal from an activated one of the plurality of fire detectors and presents an identifier of the activated one of the plurality of fire detectors on a geographic map of the secured geographic area shown on a display; and a fire progression processor that displays an indicator of a progression of a fire on the geographic map based upon the status indicator for each of the plurality of fire detectors saved in the memory and based upon a correlation between the status indicator for at least one of the plurality of fire detectors having the alarm status at a previous time period and the status indicator for the at least one of the plurality of fire detectors having the fault status at a more recent time period.

2. The apparatus as in claim 1 wherein a respective icon for each of the plurality of fire detectors is shown in a corresponding location on the geographic map.

3. The apparatus as in claim 2 wherein the respective icon for each of the plurality of fire detectors further comprises a graphic indicator representing status.

4. The apparatus as in claim 3 wherein the graphic indicator indicating the fault status further comprises a superimposed X disposed over the respective icon.

5. The apparatus as in claim 4 wherein the graphic indicator indicating the alarm status further comprises depicting the respective icon as having a predetermined color.

6. The apparatus as in claim 5 wherein the correlation between the status indicator for the at least one of the plurality of fire detectors indicating the alarm status in the previous time period and the status indicator for the at least one of the plurality of fire detectors indicating the fault status in the more recent time period further comprises depicting the respective icon as the predetermined color with the superimposed X.

7. The apparatus as in claim 1 wherein at least one of the plurality of fire detectors further comprises a multi-function detector including two or more of ionization, photoelectric, infrared, laser, heat and carbon monoxide detectors.

8. The apparatus as in claim 7 wherein the alarm processor determines a signature of the fire based upon a time value of readings from two or more of the plurality of fire detectors.

9. The apparatus as in claim 8 wherein the indicator of the progression of the fire on the geographic map further comprises shading on each zone associated with the activated one of the plurality of fire detectors.

10. The apparatus as in claim 9 wherein the alarm processor shades a smoke zone associated with detected smoke with a grey color.

11. The apparatus as in claim 10 wherein the alarm processor shades each zone associated with the activated one of the plurality of fire detectors with a predetermined color based upon a detected temperature of a respective zone.

12. The apparatus as in claim 11 wherein shading each zone associated with the activated one of the plurality of fire detectors further comprises the alarm processor superimposing an X or other symbol indicating a fault over the respective zone when the status indicator for the activated one of the plurality of fire detectors has the alarm status at the previous time period and the status indicator for the activated one of the plurality of fire detectors has the fault status for the more recent time period.

13. An apparatus comprising:

a plurality of fire detectors distributed throughout a secured geographic area;

a monitoring processor that monitors each of the plurality of fire detectors for an alarm message from activated fire detectors of the plurality of fire detectors and for a trouble message from malfunctioning fire detectors of the plurality of fire detectors;

a correlation processor that detects the trouble message followed by the alarm message from one of the plurality of fire detectors; and a fire progression processor that displays an indicator of a progression of a fire on a map of the secured geographic area presented on a display based upon the trouble message followed by the alarm message from the one of the plurality of fire detectors.

14. The apparatus as in claim 13 further comprising a respective icon of each of the plurality of fire detectors shown in a corresponding geographic location on the display.

15. The apparatus as in claim 14 wherein the respective icon for each of the plurality of fire detectors further comprises a graphic indicator of a status of a respective one of the plurality of fire detectors.

16. The apparatus as in claim 15 wherein the graphic indicator of a fault status in response to the trouble message further comprises an X or other symbol indicating the fault status disposed over the respective icon.

17. The apparatus as in claim 15 wherein the graphic indicator of an alarm status further comprises a highlighted icon.

18. An apparatus comprising:

a fire detection system that protects a secured geographic area divided into a plurality of zones;

a plurality of fire detectors distributed throughout the secured geographic area with at least one of the plurality of fire detectors disposed in each of the plurality of zones;

a monitoring processor that monitors each of the plurality of fire detectors for an alarm message from activated fire detectors of the plurality of fire detectors and for a trouble message from malfunctioning fire detectors of the plurality of fire detectors;

a correlation processor that detects the trouble message followed by the alarm message from one of the plurality of fire detectors; and a fire progression processor that displays an indicator of a progression of a fire in at least some zones of the plurality of zones adjacent to the one of the plurality of fire detectors shown on a map of the secured area presented on a display based upon the trouble message followed by the alarm message from the one of the plurality of fire detectors.

19. The apparatus as in claim 18 further comprising an alarm processor that shades the at least some zones based upon an intensity of the fire.

20. The apparatus as in claim 19 wherein the alarm processor superimposes an X indicating a fault over at least one of the at least some zones based upon the trouble message followed by the alarm message.

* * * * *